US011447920B2

(12) United States Patent
Millam

(10) Patent No.: US 11,447,920 B2
(45) Date of Patent: Sep. 20, 2022

(54) SYSTEM AND METHOD FOR HEMP REINFORCED ICE BRIDGE

(71) Applicant: Luke G. Millam, Fairbanks, AK (US)

(72) Inventor: Luke G. Millam, Fairbanks, AK (US)

( * ) Notice: Subject to any disclaimer, the term of this patent is extended or adjusted under 35 U.S.C. 154(b) by 0 days.

(21) Appl. No.: 17/581,930

(22) Filed: Jan. 23, 2022

(65) Prior Publication Data

US 2022/0145549 A1 May 12, 2022

Related U.S. Application Data

(63) Continuation of application No. 17/391,076, filed on Aug. 2, 2021, now Pat. No. 11,248,353.

(60) Provisional application No. 63/060,039, filed on Aug. 1, 2020.

(51) Int. Cl.
*E01H 4/00* (2006.01)
*E01C 11/16* (2006.01)

(52) U.S. Cl.
CPC ..... *E01H 4/00* (2013.01); *E01C 11/16* (2013.01)

(58) Field of Classification Search
CPC ..... E01H 4/00; E01C 11/16
USPC ..... 404/17–37, 72–79
See application file for complete search history.

(56) References Cited

U.S. PATENT DOCUMENTS 1,284,679 A * 11/1918 Hollier ..... D01B 1/10 19/127
1,769,630 A * 7/1930 Fischer ..... E01C 11/106 404/66
2,407,227 A * 9/1946 Earle ..... D01C 1/04 435/279
2,480,067 A * 8/1949 White ..... D01B 1/14 19/24
2,811,906 A * 11/1957 Chappell ..... D06N 3/10 156/305
3,289,425 A 12/1966 Shrier
3,616,111 A * 10/1971 Raech, Jr. ..... E01C 9/086 156/304.3
3,750,412 A 8/1973 Fitch et al.
4,057,967 A 11/1977 Hill
4,080,797 A 3/1978 Thompson
4,544,304 A 10/1985 Fisher
4,571,117 A 2/1986 Johnson et al.
(Continued)

FOREIGN PATENT DOCUMENTS

CA 2407880 * 10/2002 ..... C08L 23/04
CA 3049433 * 1/2018 ..... B32B 27/12
(Continued)

OTHER PUBLICATIONS

"Jem's Pykrete Challenge," BBC.co.uk. http://www.bbc.co.uk/bang/handson/pykrete.shtml [Date accessed: Jul. 8, 2019].

*Primary Examiner* — Raymond W Addie
(74) *Attorney, Agent, or Firm* — Christopher Mayle; Bold IP, PLLC

(57) ABSTRACT

A system and method for the construction of a hemp mat having consistent density whereby the hemp fiber mat may be used to strengthen ice or other entities for any number of applications and different types of construction designed such that it may be sturdy enough to stay bonded when it is transported, unrolled, and soaked during ice road construction but loose enough to break apart during spring to reduce blockage and environmental damage to the waterway on which the ice road was constructed.

13 Claims, 11 Drawing Sheets

(56) References Cited

U.S. PATENT DOCUMENTS

| | | | | |
|---|---|---|---|---|
| 4,767,239 | A | 8/1988 | Erwin | |
| 4,973,493 | A * | 11/1990 | Guire | A61L 27/34 427/2.24 |
| 5,679,145 | A | 10/1997 | Andersen et al. | |
| 6,099,208 | A | 8/2000 | McAlister | |
| 6,986,783 | B2 | 1/2006 | Gunn et al. | |
| 7,879,925 | B2 | 2/2011 | Chmielewski et al. | |
| 9,187,624 | B2 | 11/2015 | Lu et al. | |
| 9,238,731 | B2 | 1/2016 | Cernohous et al. | |
| 2003/0086782 | A1 | 5/2003 | Moorehead et al. | |
| 2012/0076581 | A1 | 3/2012 | LaGrotta et al. | |
| 2013/0149035 | A1 | 6/2013 | Geary | |
| 2013/0153081 | A1* | 6/2013 | Garbarino | D03D 27/08 139/420 R |
| 2013/0156501 | A1* | 6/2013 | Hemphill | B32B 5/06 428/221 |
| 2013/0167327 | A1* | 7/2013 | Lupien | D01B 1/30 19/9 |
| 2015/0197069 | A1* | 7/2015 | Basquin | B32B 5/26 264/258 |
| 2016/0130762 | A1* | 5/2016 | Ramaratnam | D21C 5/00 162/175 |
| 2018/0250549 | A1* | 9/2018 | Paton | A63B 71/0054 |
| 2019/0375202 | A1* | 12/2019 | Singletary | B32B 5/022 |

FOREIGN PATENT DOCUMENTS

| | | | | |
|---|---|---|---|---|
| GB | 573673 | * | 10/1943 | D01B 1/10 |
| HU | WO 9117883 | * | 11/1991 | B32B 5/26 |
| SE | WO 2014104955 | * | 7/2014 | D04H 5/03 |
| WO | 2009063442 A2 | | 5/2009 | |

* cited by examiner

SYSTEM AND METHOD FOR HEMP REINFORCED ICE BRIDGE

CROSS REFERENCE TO RELATED APPLICATIONS

This application is a continuation of U.S. Non-provisional application Ser. No. 17/391,076 filed on Aug. 2, 2021, which claims priority to U.S. Provisional Application No. 63/060,039 filed on Aug. 1, 2020, which are incorporated herein by reference in their entirety.

FIELD OF DISCLOSURE

The field of disclosure is generally directed to a structural material and more particularly a structural material comprising ice reinforced hemp fibers which outperforms that of conventional ice bridges.

BACKGROUND

Transporting heavy supplies to remote villages in Alaska and Canada such as Betties and Tanana can only be accomplished by vehicular floating ice roads (ice bridges). Constructing an ice bridge requires either waiting for the natural ice to reach adequate thickness or artificially thickening the ice so it can support heavy loads. This process can be time-consuming and many roads aren't able to open until late winter. Climate change has decreased the natural thickness of ice in waterways and the warmer winter temperatures lengthens the time required to artificially thicken ice. Reinforcing these floating ice roads with partially entangled hemp fibers can greatly reduce the required thickness. Thus exists the need for an invention that can help these remote arctic communities adapt to a warming environment.

Ice reinforced with other fibrous material such as wood chips has been experimented with in the past. A problem with using wood chips is that the wood chips take time to saturate in the water and subsequently insulate the water thereby requiring a longer time for the composite material to freeze. This issue has prevented wood chips from being used in many applications.

The use of fibrous material such as hemp in the design and construction of ice roads has not been developed. Current floating ice road construction consists simply of artificially thickening the ice so that it can safely support vehicular truck loads. Typical ice roads can be on the order of 6 to 8 foot thick. Preliminary testing shows that the thickness of ice roads reinforced with partially entangled hemp fibers could possibly be reduced by 2 or 3 feet. Reducing the required thickness of the floating ice roads reduces the time and cost required to construct the ice road at the beginning of winter. Thus, there still exists the need for an improved system and method for reinforcing ice bridges and roads using hemp as the fibrous material.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
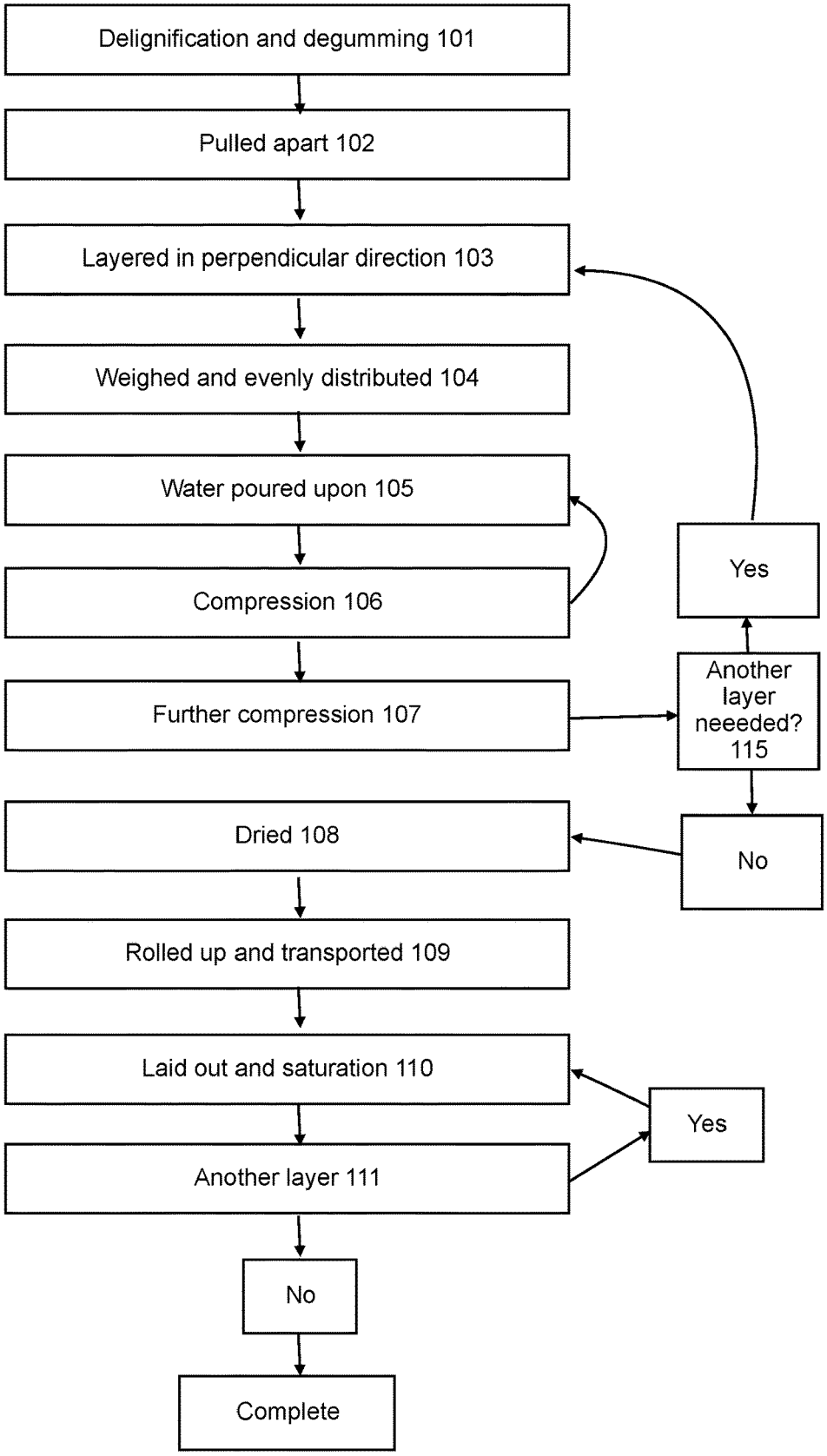
FIG. 1 is an illustration of an exemplary method for a hemp reinforced ice bridge.

In the Summary above and in this Detailed Description, and the claims below, and in the accompanying drawings, reference is made to particular features (including method steps) of the invention. It is to be understood that the disclosure of the invention in this specification includes not all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure is generally directed to a system and method of use, according to one or more exemplary embodiments, for a novel structural material comprising ice reinforced hemp fibers as well as methods for production of the same. The structural material mechanical strength outperforms that of conventional ice bridges. In addition, this material offers many other significant advantages including improved ductility with minimal environmental impact.

The present invention, as described in one or more non-limiting embodiments, is directed to a construction of a hemp mat having consistent density. In other non-limiting embodiments, other fibrous raw material such as cotton, wool, or synthetic fibers may also be used. The hemp fiber mat may be used to strengthen ice or other entities for any number of applications and different types of construction. Because of the uniformity of the hemp fibers in the hemp mat, reliable design guides may be developed to use this partially entangled hemp fiber for ice road construction. The entangled hemp fiber provides an advantage over untreated fibrous material in that the compressed form wicks water into its volume and does not entrap air as much as untreated fibrous material. Air bubbles entrapped in ice greatly reduce the strength of the composite ice material. Another advantage is that the partially entangled hemp mat is designed such that it may be sturdy enough to stay bonded when it is transported, unrolled, and soaked during ice road construction but loose enough to break apart during spring to reduce blockage and environmental damage to the waterway on which the ice road was constructed. Additional details are provided below with respect to the Figures.

Hemp stems used in the construction of the present invention, according to one or more non-limiting embodiments, typically have a chemical composition of natural fibers as well as cellulose in the microfiber of the cell wall, hemicelluloses, lignin, and other minor biopolymer components of the cell wall.

Partially entangling long raw hemp fibers begins with the raw hemp fibers. The raw hemp fibers are initially matted and clumped together with pieces of hemp hurd mixed in the fiber. This matted hemp fiber is initially placed into a picking machine to pull the hemp clumps apart.

The picking machine consists of two nail boards that grab the hemp fibers and pull them in opposite directions. This is the same style of picking machine used in processing wool. When the clumps of hemp are pulled apart, debris that is bound in the hemp fibers such as the pieces of hurd fall out of the fibers. The resulting hemp fibers are clean and loosely connected.

Once the hemp fibers have gone through the picking machine, they are weighed and distributed evenly across a flat surface or in the form of an ice beam. After the loose hemp is spread evenly across the surface at approximately 0.08 lb/ft^2, the hemp fibers are wetted, compressed, and agitated. The loose hemp fibers may be compressed and agitated with a palm sander that did not have any sandpaper attached. After the hemp has been fully compressed, another layer of loose hemp is laid over the top of the existing layer, wetted, compressed, and agitated again.

This process continues until the design thickness of the hemp mat has been achieved. The general direction of the hemp strands in each layer are alternated perpendicular to each other in subsequent layers. Once all layers of the hemp mat have been compressed, the water is compressed out of the mat and it is laid out to dry. The fibers in the dried hemp mat are partially entangled. The dried hemp mat can then be rolled up, stored, and transported to the location where it will be frozen into the ice.

Figure 2:
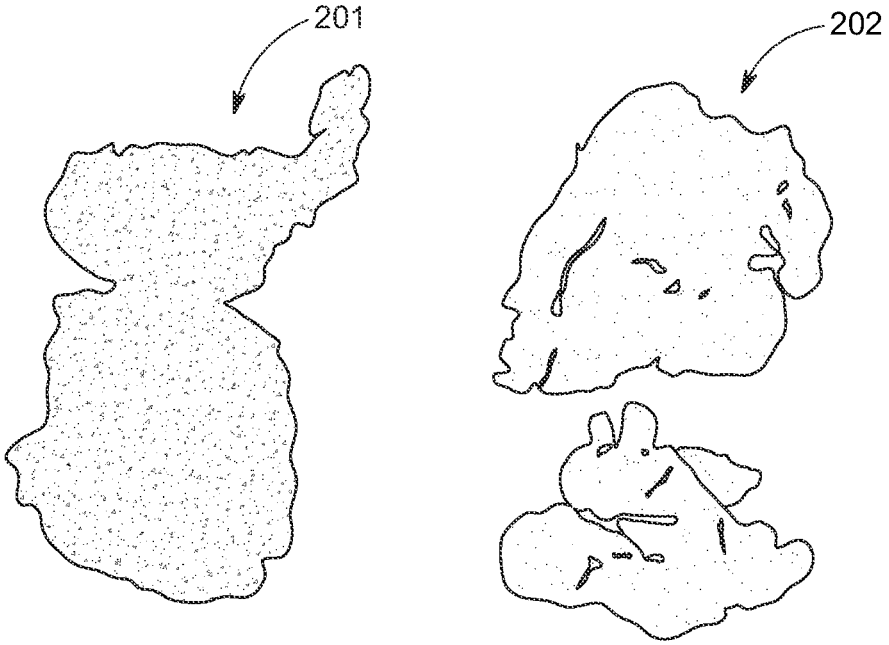
FIG. 2 is an illustration of raw hemp fibers and degummed hemp fibers.

FIG. 1 provides a flowchart of an exemplary method of constructing an ice road of reinforced hemp. In one or more non-limiting embodiments, the method may begin at step 101 by delignification and degumming hemp stems. Delignification and degumming relates to the elimination of lignins, pectins, gums, and hemicellulose from the hemp stem leaving only cellulose in its natural form of thin cellulosic fibers or fibrils. An illustration of raw hemp fiber 201 and degummed fiber 202 is shown in FIG. 2. Degummed fiber 202 has been degummed such that the lignin has been removed. In this stage, the hemp is clumped in random densities. These fibers in their current state may tend to clump and become matted in different densities leading to inconsistent strength values when used to reinforce ice.

Figure 3:
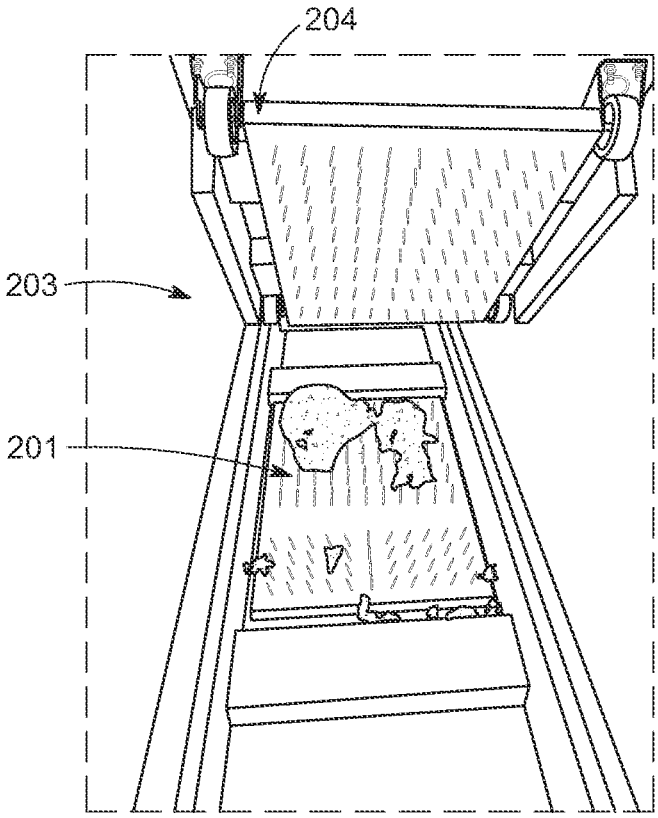
FIG. 3 is an illustration of the hemp fibers being separated by nails on a nail board.
Figure 4:
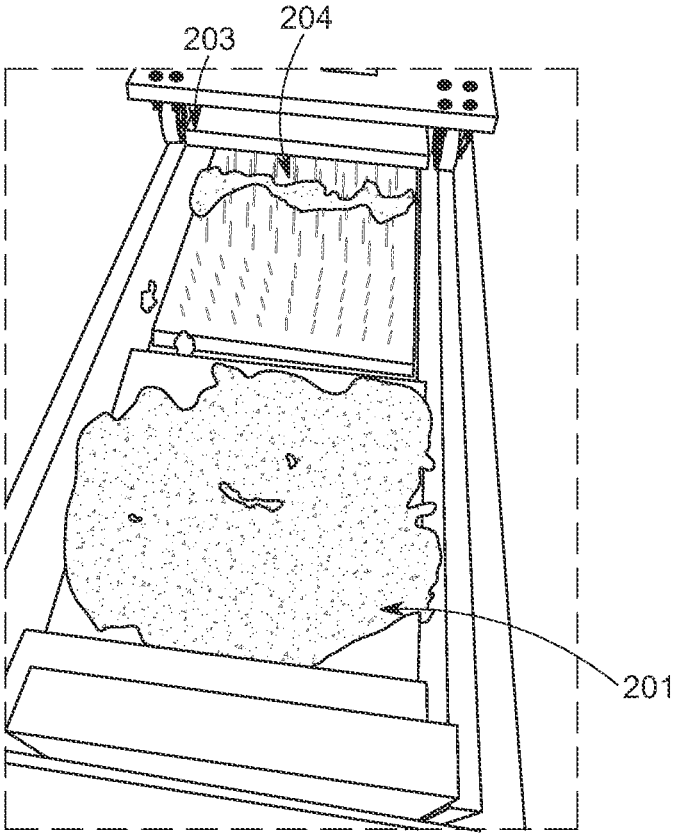
FIG. 4 is another illustration of the hemp fibers being separated by nails on a nail board.
Figure 5:
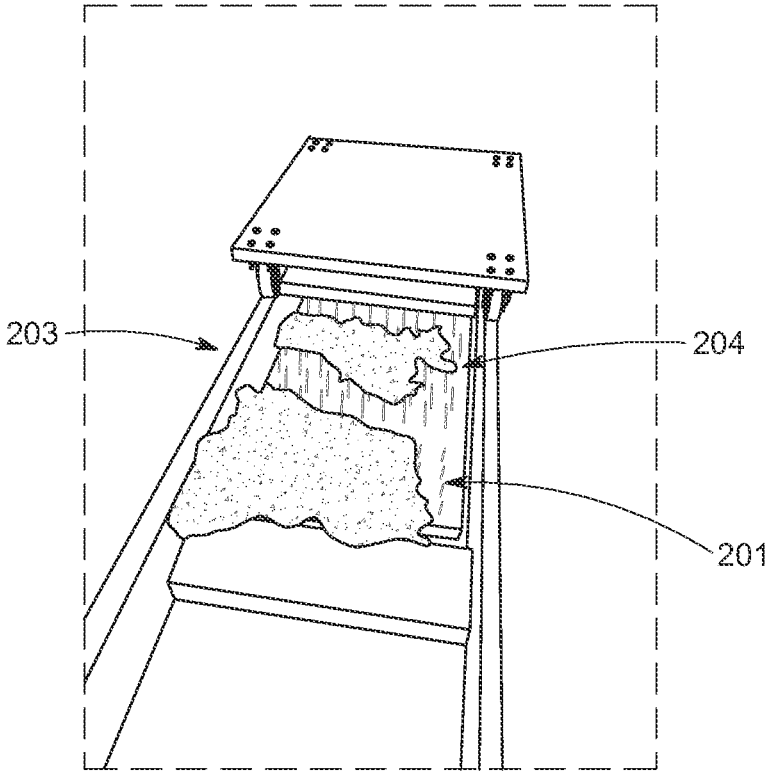
FIG. 5 is another illustration of the hemp fibers being separated by nails on a nail board.
Figure 6:
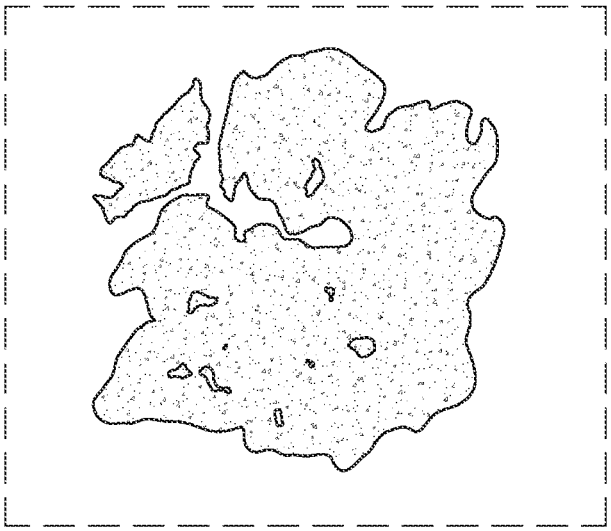
FIG. 6 is an illustration of loose hemp before being layered.

At step 102, the hemp fiber clumps may be pulled apart into a lighter fluffier form. This process may be carried out by picker machines which include several steel nails similar to those used in wool processing to separate the hemp fiber. Exemplary picker machines 203 having a plurality of steel nails 204 are illustrated in FIGS. 3-5. The hemp may be separated by nails 204 that have a specific pattern which moves the hemp from one side to the other. Nails 204 are pushed back and forth across each other to separate the hemp. The separated hemp may be passed through the picker machines shown in FIGS. 3-6 multiple times to achieve the desirable result. This action produces a hemp that is much more loose and able to bind with itself as illustrated in FIG. 6.

Continuing with step 103 as shown in FIG. 1, after the hemp is pulled apart, the hemp may be layered into a mat such that fibers are facing in perpendicular directions with each individual layer. An illustration of a layered hemp mat 210 is shown in FIG. 7.

Figure 7:
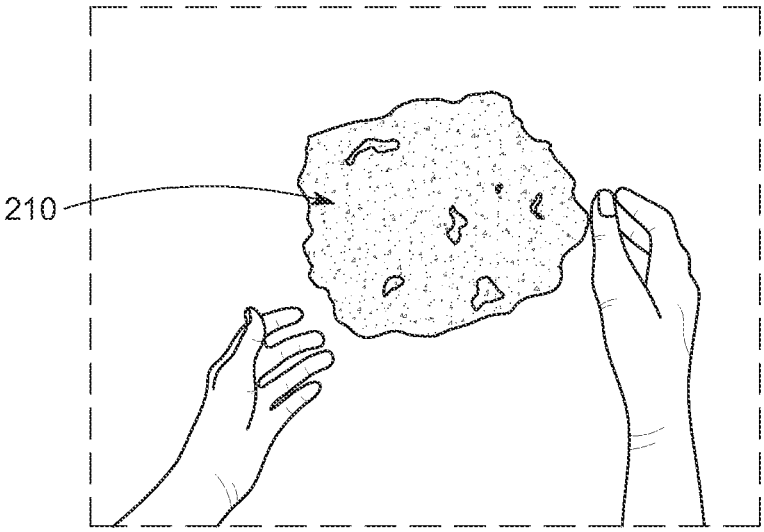
FIG. 7 is an illustration of hemp after being layered into a mat.

The layering of the hemp into a mat 210 as shown in FIG. 7 whereby the hemp fibers are facing perpendicular directions prevents the hemp from being strong in only one direction, thus allowing the fibers to bind from side to side as well as lengthwise, thereby creating a more uniform shape. If the layering of the fibers in perpendicular directions is not performed, the process could cause uneven distribution when binding.

At step 104, the hemp fibers may then be weighed and evenly distributed onto a flat surface such as a floor or table. This ensures a uniform density and distribution of hemp fibers. Understanding the density of the hemp in this step is critical to understanding the final design strength of the composite ice material.

At step 105, water or another suitable liquid solution may then be poured onto the hemp so that the hemp may bind with itself. The water creates friction and helps the hemp fibers bind to themselves. This process is analogous to felting wool whereby water is used to compress and bind the wool to create felt. Using a similar concept with hemp fibers, the fibers are able to bind to themselves and create more uniform material instead of being loosely put together.

Figure 8:
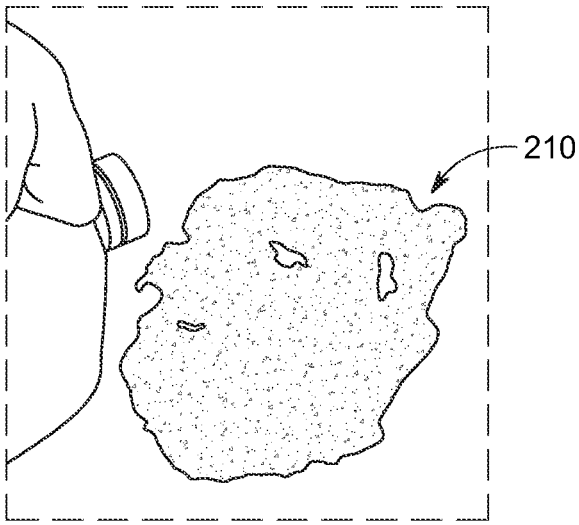
FIG. 8 is an illustration of saturating the hemp mat.
Figure 9:
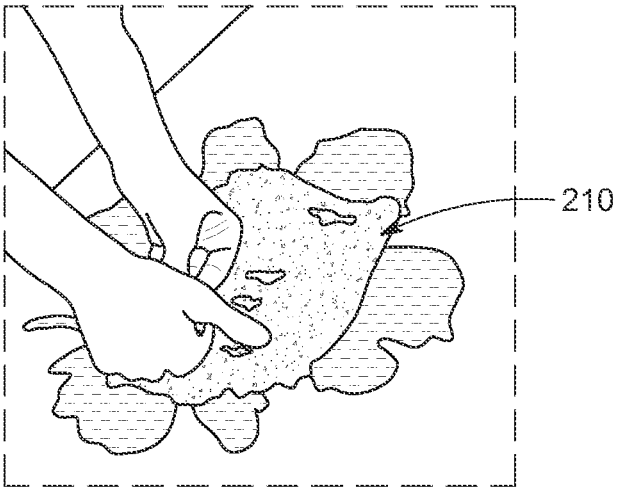
FIG. 9 is an illustration of compressing the hemp mat.
Figure 10:
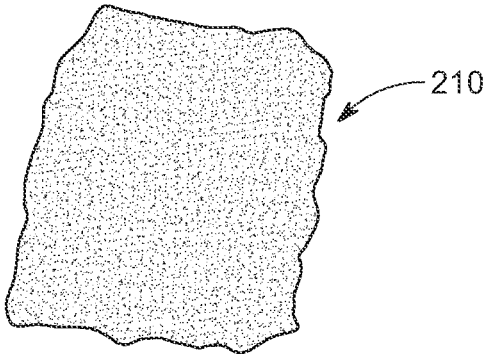
FIG. 10 is an illustration of the hemp mat after being compressed and saturated.

Once water has been poured onto the hemp, the hemp may then be compressed by an outside force such as hand pressure so that it becomes fully saturated, as shown at step 106 in FIG. 1. The process of pouring water and compression of steps 103 and 104 may be cycled through multiple times to achieve the desirable result as shown at step 115. If the pouring and compression is longer needed, the method may proceed to step 107. An illustration of the pouring of water and compression is illustrated in FIGS. 8-10.

Figure 11:
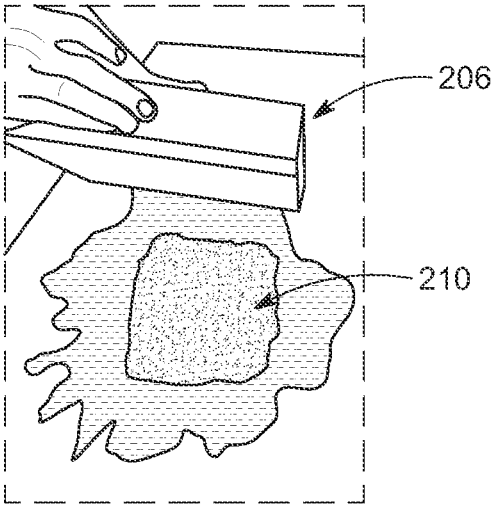
FIG. 11 is an illustration of additional compression of the hemp mat between two surfaces.
Figure 12:
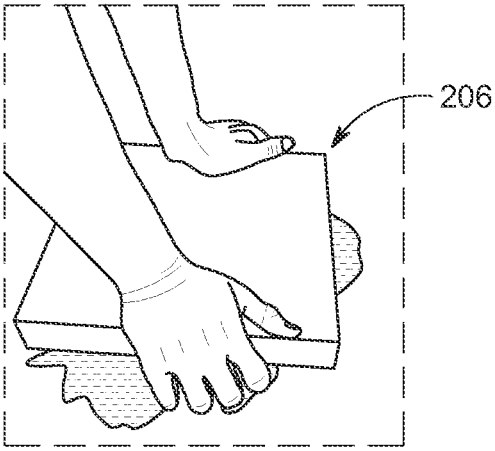
FIG. 12 is another illustration of additional compression of the hemp mat between two surfaces.

At step 107, the wet hemp fibers may then be further compressed between two flat hard surfaces. In one or more embodiments, for example, the hemp may be compressed using a wooden board 206 or other hard flat surface as illustrated in FIGS. 11-12. Wooden board 206 may be twisted back and forth or gently agitated in another type of motion to tease the hemp fibers together, causing the mat to become more cohesive. After the fibers have been compressed and agitated, an additional layer of hemp fiber may be added to the top of the mat whereby mat 210 with the newly introduced layer may then proceed through the saturation, compression, and agitation steps once again at step 115. This process may continue with additional layers of fibers being added until the desired thickness and mat density is achieved.

Figure 13:
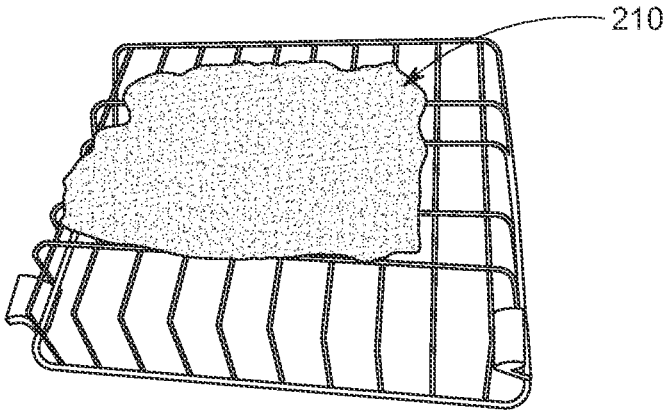
FIG. 13 is another illustration of the hemp mat being left out to dry.

While this process may be considered similar to creating felt or hydro entanglement of fibrous material, the objective in this invention is not to create too strong of a bond between the fibers. The goal is to make a mat that is cohesive enough for transportation and placement during construction of an ice road, but also weak enough that it will break apart in the springtime when the ice road thaws, thereby reducing its environmental impact on the waterway so that any environmental damage is avoided Continuing with step 108 in FIG. 1, mat 210 may then be dried. FIG. 13 is a pictorial illustration of an exemplary way to dry mat 210 shown in FIGS. 11-12. The circulation or addition of heat or air may assist in the speed of drying the hemp mat. Drying prevents mat 210 from getting moldy and reduces the weight of mat 210 for transportation and handling.

Figure 14:
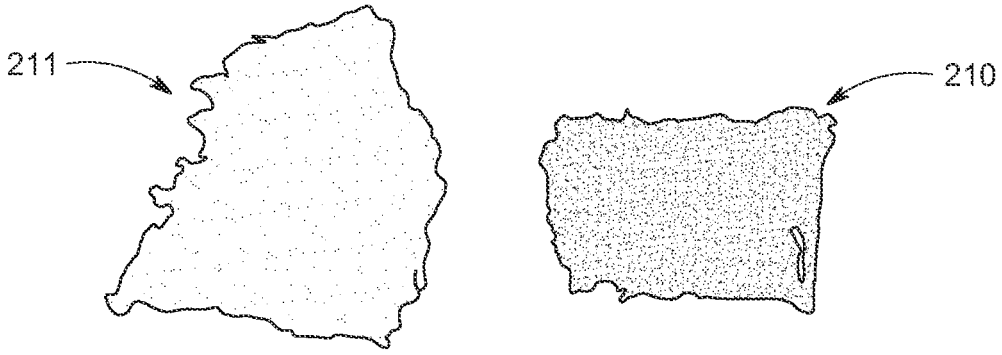
FIG. 14 is an illustration of the mat of raw hemp fibers and the mat of degummed hemp fibers.
Figure 15:
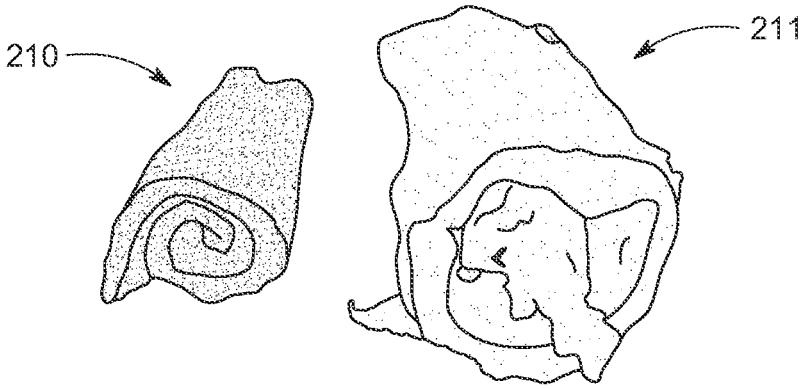
FIG. 15 is an illustration of the mat of raw hemp fibers and the mat of degummed hemp fibers rolled up.
Figure 16:
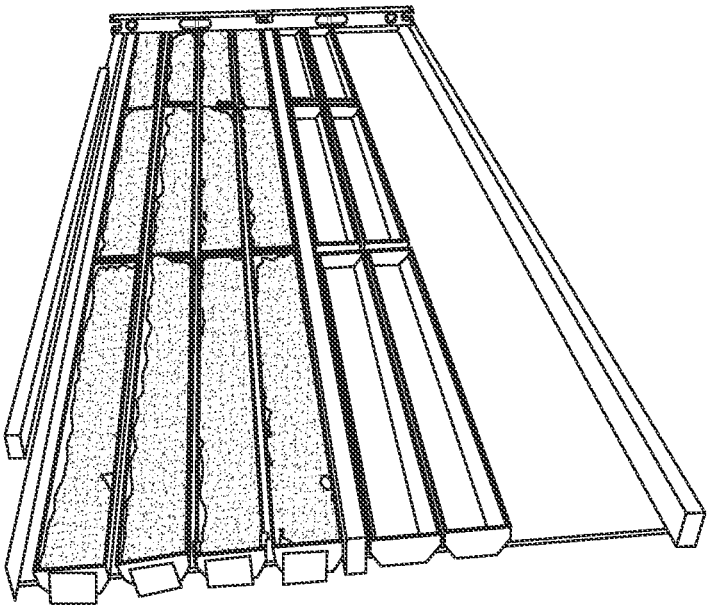
FIG. 16 is an illustration of the mat of raw hemp fibers being frozen in water.

At step 109, once dried as illustrated in FIG. 14, mat 210 and degummed mat 211 (e.g., as shown in FIG. 14) may be rolled up to facilitate storage and transportation, as illustrated in FIG. 15 and FIG. 16. As previously discussed, the newly formed partially entangled hemp mat 211 may be used to strengthen ice for any number of applications. In one or more non-limiting embodiments, the newly formed hemp mat 211 may be particularly useful in ice road construction.

Ice road construction may begin when the natural ice thickness of a water way is thick enough to support foot traffic and construction equipment to move onto the ice (e.g., typically when the ice thickness is at a minimum of 6 inches). All snow and other debris would be cleared off of the existing natural ice surface. At step 110, the partially entangled hemp mats 211 may then be unrolled onto the surface of the ice. Depending on the length and width of the utilized roadway, the multiple hemp mats are laid out across the ice. The hemp mats may overlap with one another at the edges of mat 211 to ensure a continuous fiber matrix across the whole roadway. Mats 211 are layered such that each layer is laid out perpendicular to the one just below.

Continuing with step 110 in FIG. 1, holes on the perimeter of the roadway are cut into the ice to access water. Once the mats have been positioned, water may then be pumped from the waterway onto the hemp mats completely saturating the mats. In locations where water from the waterway is inaccessible, water may be transported to the ice road to saturate the hemp mats. It should be ensured that the mats are properly saturated to ensure no air pockets or bubbles become entrapped inside the ice. If air bubbles do occur, the air bubbles may be expelled by gently compressing the hemp mats under the water.

Once the hemp mats have been saturated, it should be ensured the water does not leak out of the saturated hemp mat while it is freezing, creating air voids. In ice road construction, this may be accomplished by first thickening the ice along the perimeter of the roadway creating ice berms that are capable of containing the water when the hemp mat is flooded. The time for how fast saturated hemp freezes is dependent on the ambient air temperature at the time of construction and the thickness of the hemp mat and water level being frozen.

Continuing with step 111 in FIG. 1, multiple hemp mats may be frozen in different layers or lifts whereby a thin layer of hemp is frozen onto the ice surface and then another thin layer of hemp is placed on top of the existing frozen layer. This process may continue until the final design mass of hemp has been frozen into the roadway. Typically, only the bottom portion of the total ice road thickness would need to be reinforced with the hemp mat. Because the bottom surface experiences the largest tensile forces when loaded with vehicular traffic, the upper thickness of the ice can be unreinforced as natural ice is strong in compression.

Figure 17:
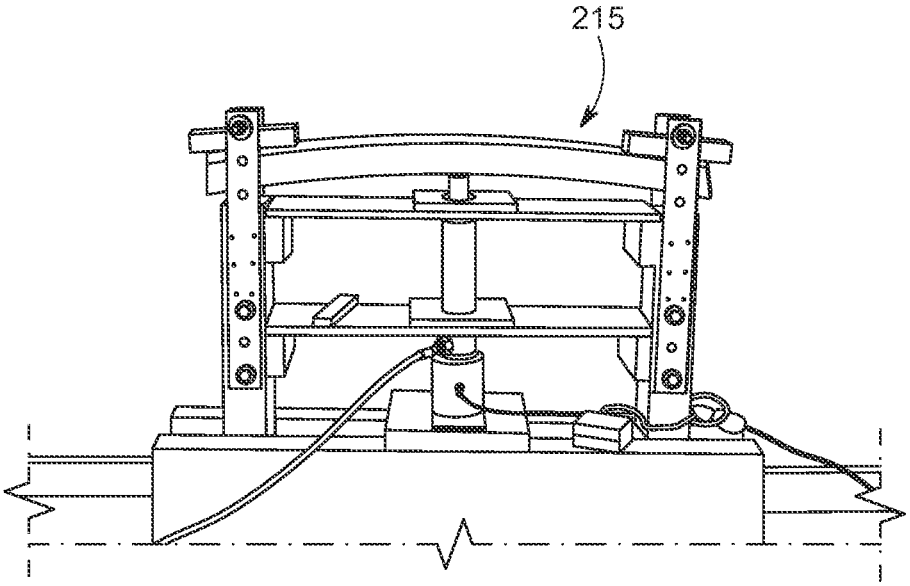
FIG. 17 is an illustration of the mat of raw hemp fibers under stress after being frozen.
Figure 18:
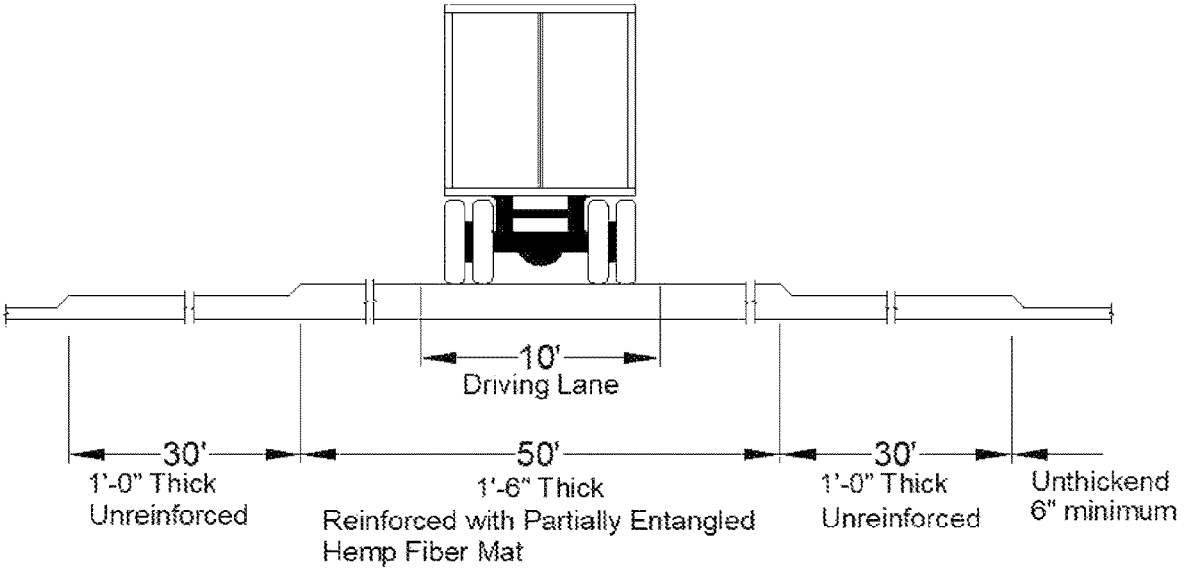
FIG. 18 is an illustration of a possible design thickness for an ice road.

An illustration of a component of the resulting reinforced ice bridge 215 is illustrated in FIG. 17, showcasing the increased strength and ductility. A theoretical design thickness for an ice road capable of supporting an HS-20 truck load with a 10 foot wide driving lane is illustrated in FIG. 18. The ice road may include a 50 foot wide by 1 foot 6 inches thick reinforced section with partially entangled hemp fiber mats. This ice road greatly reduces the thickness of the ice to obtain a safety factor of 2. If the same design and assumptions were to be used for normal ice, the thickness needed would be approximately 2'-6", which is an entire foot larger than when reinforced with hemp.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. A method of constructing hemp, the method comprising:

layering hemp such that hemp fibers are facing in a perpendicular directions with each individual layer to form a hemp mat; and compressing and agitating the hemp fibers with a palm sander.

2. The method of claim 1 further comprising compressing the hemp fibers in a twisting back and forth or gently agitated in another type of motion to tease the hemp fibers together, causing the hemp mat to become more cohesive.

3. The method of claim 1 further comprising weighing the hemp fibers and evenly distributing the hemp fibers onto a flat surface to ensure a uniform density and distribution of the hemp fibers when forming the hemp mat.

4. The method of claim 3 further comprising pouring a liquid onto the hemp fibers so that the hemp fibers bind with themselves.

5. The method of claim 1 further comprising adding an additional layer of the hemp fibers to a top of the hemp mat wherein the mat with the additional layer.

6. The method of claim 5 further comprising repeating steps of adding the additional layer of the hemp fiber.

7. The method of claim 6 further comprising drying the hemp mat.

8. A method of constructing reinforced hemp, the method comprising: compressing hemp fibers of a hemp mat with a wooden board wherein the wooden board is twisted back and forth or gently agitated in another type of motion to tease the hemp fibers together causing the hemp mat to become more cohesive.

9. The method of claim 8 further comprising pulling hemp fiber clumps into separated hemp.

10. The method of claim 8 further comprising pulling hemp fiber clumps by one or more picker machines, the one or more picker machines including nails, wherein the nails are pushed back and forth across each other to separate the hemp fiber clumps.

11. The method of claim 8 further comprising layering separated hemp such that the hemp fibers are facing in perpendicular directions with each individual layer to form a hemp mat; and weighing the hemp fibers and evenly distributing the hemp fibers onto a flat surface to ensure a uniform density and distribution of the hemp fibers when forming the hemp mat.

12. The method of claim 8 further comprising pouring a liquid onto the hemp fibers so that the hemp fibers bind with themselves; and compressing the hemp fibers so that it becomes fully saturated.

13. The method of claim 11 further comprising drying the hemp mat.

* * * * *